United States Patent [19]

Kobayashi

[11] 4,143,632

[45] Mar. 13, 1979

[54] FUEL INJECTION TIMING CONTROL DEVICE

[75] Inventor: Masayoshi Kobayashi, Matsuyama, Japan

[73] Assignee: Diesel Kiki Company, Ltd., Tokyo, Japan

[21] Appl. No.: 707,401

[22] Filed: Jul. 21, 1976

[30] Foreign Application Priority Data

Jul. 26, 1975 [JP] Japan ..... 50-103478[U]

[51] Int. Cl.[2] ..... F02M 61/06; F02M 63/00; F02M 45/00

[52] U.S. Cl. ..... 123/139 AQ; 123/179 L

[58] Field of Search ..... 123/179 L, 139 AP, 139 AQ

[56] References Cited

U.S. PATENT DOCUMENTS

| | | | |
|---|---|---|---|
| 2,965,089 | 12/1960 | Holley, Jr. | 123/179 L |
| 2,965,090 | 12/1960 | DeClaire, Jr. | 123/179 L |
| 2,965,092 | 12/1960 | DeClaire, Jr. | 123/179 L |
| 3,951,117 | 4/1976 | Perr | 123/139 AP |

*Primary Examiner*—Charles T. Jordan
*Assistant Examiner*—Thomas H. Webb
*Attorney, Agent, or Firm*—Frank J. Jordan

[57] ABSTRACT

A fuel injection timing control device for an engine comprises a control member which is mechanically connected to a fuel injection pump to control the injection timing or advance angle. The output pressure of an engine driven low pressure supply pump for the fuel injection pump is balanced against the force of a spring by means of first piston which is connected to position the control member. A second piston and spring combination is exposed to the supply pump pressure in such a manner that the second piston engages with and moves the first piston and thereby the control member to a timing advance position when the engine is being started and the engine speed and the supply pump pressure are very low in order to reduce the emission of pollutants.

5 Claims, 7 Drawing Figures

FUEL INJECTION TIMING CONTROL DEVICE

BACKGROUND OF THE INVENTION

The present invention relates to a fuel injection timing control device for an internal combustion engine which comprises means for advancing the injection timing when the engine speed is very low such as during starting.

Fuel injection pumps for internal combustion engines, especially of the combustion ignition or Diesel type, preferably comprise means for regulating the amount of fuel injection and also the timing in the engine cycle at which the fuel is injected. It is known to control the latter function, especially in distribution type injection pumps, by means of a hydraulic injection timing control device which advances the injection timing in generally proportional relation to the pressure of an engine driven low pressure fuel supply pump. The supply pump is driven by the engine in such a manner that the supply pump pressure increases as the engine speed increases.

However, it is desirable to advance the injection timing under extremely low engine speed operating conditions, such as during starting, in order to reduce the emission of unburned fuel constituents from the engine which appear as black smoke. Heretofor, the injection timing control devices which have been provided for engines are operative to advance the injection timing only as the engine speed increases, with substantially zero advance at low engine speed, thereby leaving unsolved the above mentioned problem of pollutant emission.

SUMMARY OF THE INVENTION

It is an object of the present invention to provide a fuel injection timing control device for use with a fuel injection pump for an internal combustion engine which reduces the emission of unburned fuel constituents at low engine speed.

It is another object of the present invention to provide an injection timing control device comprising means for advancing the injection timing at extremely low engine speeds.

It is another object of the present invention to provide an injection timing control device responsive to the pressure of a fuel supply pump comprising a first piston unit to control the fule injection timing as a function of said pressure at normal operating engine speeds and a second piston unit responsive to said pressure to advance the injection timing at very low engine speeds.

Other objects, together with the foregoing, are attained in the embodiment described in the following description and illustrated in the accompanying drawings.

DESCRIPTION OF THE PREFERRED EMBODIMENT

While the fuel injection control device of the invention is susceptible of numerous physical embodiments, depending upon the environment and requirements of use, substantial numbers of the herein shown and described embodiment have been made, tested and used, and all have performed in an eminently satisfactory manner.

Figure 4:
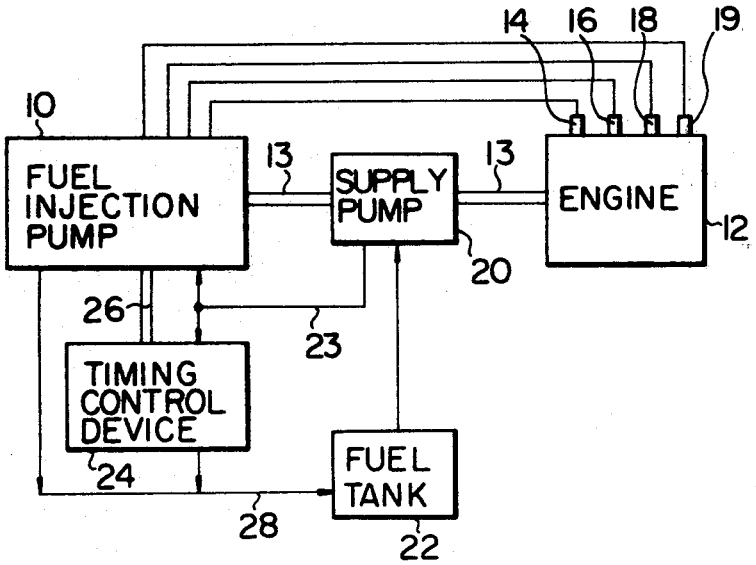
FIG. 4 is a block diagram of a fuel injection system incorporating an injection timing device embodying the present invention.

Referring now to FIG. 4 of the drawings, a distribution type fuel injection pump 10 is connected to inject fuel into a combustion ignition or Diesel engine 12. The pump 10 is driven by the engine 12 through a shaft 13 so as to sequentially feed fuel to injection nozzles 14, 16, 18 and 19 which open into the cylinders (not shown) of the engine 12 respectively as the pistons (not shown) approach their top dead center positions.

A low pressure fuel supply pump 20 which is also driven by the engine 12 through the shaft 13 is arranged to pump liquid fuel such as Diesel oil from a non-pressurized fuel tank 22 through a fuel supply or pressure passageway 23 to the injection pump 10. The supply pump 20 also supplies fuel through the pressure passageway 23 to a fuel injection timing control device 24 which is an embodiment of the present invention, and is operatively connected to control the fuel injection pump 10 by an injection control member 26. A non-pressurized return line 28 leads from the fuel injection pump 10 and timing control device 24 to the fuel tank 22.

Figure 1:
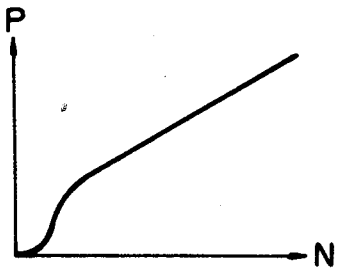
FIG. 1 is a graph illustrating the relationship between supply pump pressure and engine speed of a fuel injection pump to which the present invention is applicable.

The output or supply pressure P of the supply pump 20 is shown in FIG. 1 as a function of the rotational speed N of the engine 12. It will be seen that the supply pressure P increases in a generally proportional manner as the engine speed N increases.

Figure 2:
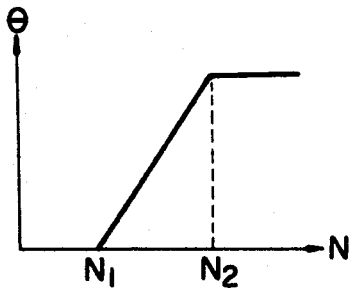
Fig. 2 PRIOR ART
FIG. 2 is a graph illustrating the relationship between injection timing advance angle and engine speed of a prior art injection control device in response to the supply pump pressure shown in FIG. 1.

FIG. 2 illustrates operation of a prior art injection timing control device which the present device 24 is intended to replace. Designated as $\theta$ is the injection timing advance angle, or angle of the crankshaft (not shown) of the engine 12 before top dead center of the pistons at which the fuel injection pump 10 performs fuel injection. The fuel injection pump 10 is of conventional design and the detailed configuration is not shown. However, the injection pump 10 comprises means for varying the advance angle $\theta$ in dependence on the position of an injection control member corresponding to the present control member 26.

The prior art timing control device is responsive to the supply pressure P and controls the advance angle $\theta$ in dependence thereon through the control member as shown in FIG. 2. It will be noticed that the advance angle $\theta$ is zero for engine speeds below the value N1, increases generally linearly between the speed N1 and a speed N2 and remains constant at speeds higher than N2. The prior art injection timing control device does not comprise means for advancing the injection timing when starting the engine or under other very low speed operating conditions, and the emission of black smoke is a natural consequence.

Figure 3:
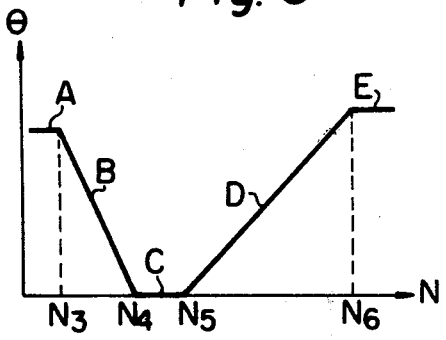
FIG. 3 is a graph illustrating the relationship between the injection timing advance angle and engine speed of an injection timing control device embodying the present invention in response to the supply pump pressure shown in FIG. 1.

The operation of the present injection timing control device 24 in response to the supply pressure P shown in FIG. 1 is illustrated in FIG. 3. It will be seen that below an engine speed N3, the advance angle $\theta$ has an appropriately high value as shown by a curve portion A to prevent pollutant emission during starting of the engine 12. The advance angle $\theta$ decreases generally linearly between engine speeds N3 and N4 in a curve portion B as the engine 12 is started down to zero at the engine speed N4. The advance angle $\theta$ remains at zero in a curve portion C until the engine speed increases to N5 and then increases generally linearly in a curve portion D up to an engine speed N6. The advance angle $\theta$ is constant at speeds above N6 in a curve portion E.

Figure 5:
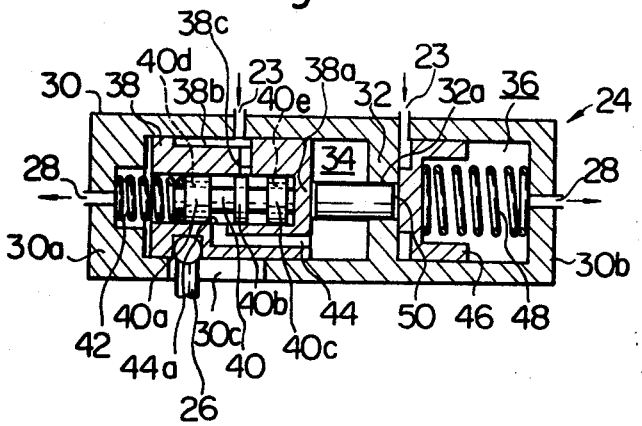
FIG. 5 is a longitudinal sectional view of the injection timing control device embodying the present invention operating in a portion A of the curve of FIG. 3.
Figure 6:
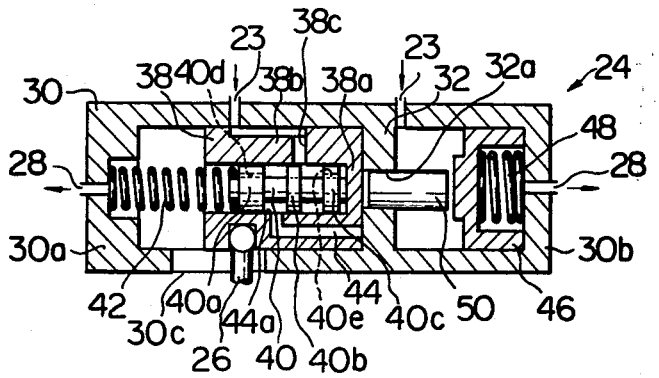
FIG. 6 is similar to FIG. 5 but shows operation in a curve portion C of FIG. 3.
Figure 7:
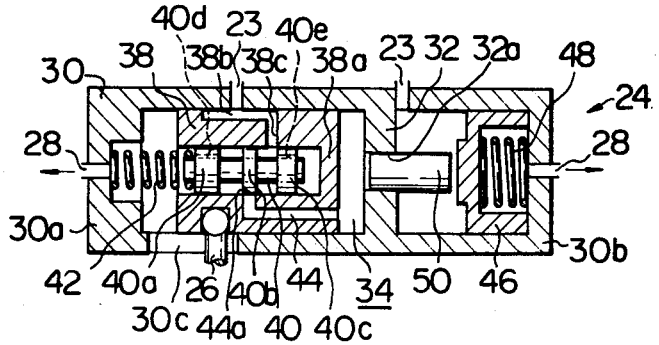
FIG. 7 is similar to FIG. 5 but shows operation in a curve portion D of FIG. 3.

The detail configuration of the timing control device 24 is shown in FIGS. 5 to 7 which represent operation in the curve portions A, C and D respectively. The control device 24 comprises a housing 30 which is bored and has closed ends 30*a* and 30*b*. A partition 32 divides the bore of the housing 30 into a first chamber 34 and a second chamber 36. The pressure passageway 23 opens into the first and second chambers 34 and 36 as shown, and the return passageway 28 opens into the first and second chambers 34 and 36 through the closed ends 30*a* and 30*b* respectively.

A power piston 38 is sealingly slidable in the first chamber 34. The power piston 38 is bored and has a closed end wall 38*a* facing the partition 32. A valve spool or first piston 40 is sealingly slidable in the bore of the power piston 38 and is urged toward the end wall 38*a* thereof and the partition 32 by a first compression spring 42. The piston 40 is formed with three lands 40*a*, 40*b* and 40*c*. The spring 42 seats against the land 40*a*, which is formed with an axial passageway 40*d* connecting the space between the lands 40*a* and 40*b* with the return passageway 28. The land 40*c* is formed with an axial passageway 40*e* connecting the space between the land 40*c* and the end wall 38*a* with the space between the lands 40*b* and 40*c*.

The housing 30 is formed with a slot 30*c*. The control member 26 is connected to the power piston 38 for unitary movement and extends through the slot 30*c* for connection with the injection pump 10. The pressure passageway 23 is extended into the bore of the power piston 38 between the land 40*b* and the end wall 38*a* by means of an axial slot 38*b* and a radial passageway 38*c* formed in the power piston 38. A power passageway 44 leads from the bore of the power piston 38 at an opening 44*a* and communicates with the space between the end wall 38*a* of the power piston 38 and the partition 32.

A second piston 46 is sealingly slidable in the second chamber 36 and is urged toward the partition 32 by a second compression spring 48. The portion of the second chamber 36 between the piston 46 and the end 30*b* is connected to the return passageway 28 to return any fuel which leaks past the piston 46 to the fuel tank 22.

The partition 32 is formed with a central opening 32*a* through which a rod 50 sealingly extends for engagement with the end wall 38*a* of the power piston 38.

A rightmost position of the control member 26 corresponds to minimum timing advance angle $\theta$ and a leftmost position of the control member 26 corresponds to maximum timing advance angle $\theta$.

The preloads of the springs 42 and 48 and the diameters of the pistons 40 and 46 are selected to fulfill the following relationship $$F1/A1 > F2/A2 \quad (1)$$

where F1 is the preload of the spring 42, A1 is the area of the piston 40 exposed to the pressure passageway 23, F2 is the preload of the spring 48 and A2 is the area of the piston 46 exposed to the pressure passageway 23. In addition, $$P1 > P2 > Ps$$

where P1 is the value of the supply pressure P at the engine speed N5 and has the value F1/A1, P2 is the value of the supply pressure P at the engine speeds N4 and P3 is the value of the supply pressure P at the engine speed N3 and has the value F2/A2.

The operation of the timing control device 24 will now be described with reference to the drawings.

Curve portion A (FIG. 5)

For engine speeds lower than N3, such as during starting of the engine 12, the supply pressure P is lower than P3. The physical interpretation of the pressure P3 is such that the pressure P3 acting on the piston 46 is just sufficient to overcome the preload of the spring 48. The pressure P3 is insufficient to overcome the preload of the spring 42 in accordance with equations (1) and (2). The spring 48, at engine speeds lower than N3 thereby moves the piston 46 leftwardly into abutment with the partition 32. The rod 50 is moved by the piston 46 into engagement with the power piston 38. The stiffness of the spring 46 is necessarily greater than that of the spring 42, and the power piston 38 and control member 26 are moved leftwardly by the rod 50 to the advanced timing position illustrated by the curve portion A in FIG. 3. The spring 42 urges the first piston 40 rightwardly into abutment with the end wall 38*a* of the power piston 38. In this manner, the injection timing angle $\theta$ is advanced as desired during starting of the engine 12 when the engine speed N is low.

Curve portion B

As the engine 12 starts and the supply pressure P increases, the supply pressure P acts on the second piston 46 to urge the same rightwardly against the force of the spring 48. The spring 42 urges the first piston 40, power piston 38, rod 50 and control member 26 rightwardly in a unitary manner with the second piston 46. At the engine speed N4 and the supply pressure P2, the end wall 38*a* of the power piston 38 abuts against the partition 32 and the second piston 46 just beings to move rightwardly out of engagement with the rod 50 and power piston 38. The advance angle $\theta$ is zero.

Curve portion C (FIG. 6)

At engine speeds between N4 and N5, the supply pressure P is between P2 and P1. The supply pressure P is sufficient to cause the second piston 46 to disengage from the power piston 38 but insufficient to overcome the preload of the spring 42. The advance angle $\theta$ remains zero.

Curve portion (FIG. 7)

At engine speeds between N5 and N6 and respective supply pressures above P1, the second piston 46 is moved rightwardly to such an extent as to be inoperative. However, the supply pressure P acts on the right face of the land 40*b* of the first piston 40 thereby urging the first piston 40 leftwardly against the force of the spring 42. When the first piston 40 has moved sufficiently leftwardly that the land 40*b* moves past the opening 44*a* of the power passageway 44, the supply pressure P from the supply passageway 23 is introduced into the space between the end wall 38*a* of the power piston 38 and the partition 32 through the power passageway 44. The pressure P acts on the right face of the end wall 38*a* causing the power piston 38 to move leftwardly until the land 40*b* is aligned with the opening 44*a* to block the same. Although the pressure P acts on the left face of the end wall 38*a* in a direction opposite to the action on the right face thereof, the surface area of the right face of the end wall 38*a* is greater than the surface area of the left face thereof and the net force is in the leftward direction. The control member 26 moves with the power piston 38 to advance the injection timing.

As the supply pressure P increases further, the first piston 40 is moved leftwardly thereby so that the land 40*b* again connects the power passageway 44 with the pressure passageway 23. The increased pressure on the right face of the end wall 38*a* of the power piston 38 moves the power piston 38 further leftwardly until the opening 44*a* is again covered by the land 40*b*.

If, under these conditions, the engine speed N is decreased and the supply pressure P accordingly decreased, the first piston 40 will be moved rightwardly by the first spring 42. This will cause the land 40*b* to move past the opening 44*a* to connect the power passageway 44 with the return passageway 28. In response to the substantially zero pressure acting on the right face of the end wall 38*a* of the power piston 38, the pressure P acting on the left face of the end wall 38*a* of the power piston 38 will move the power piston 38 right rightwardly until the land 40*b* blocks the opening 44*a*. It will be seen that this configuration acts as a power amplifier connecting the first piston 40 to the control member 26 in such a manner that the control member 26 moves along with the first piston 40.

Curve portion E

Above the engine speed N6, the supply pressure P is so great so as to cause the power piston 38 to abut against the end 30*a*. There is no further increase in timing advance engle $\theta$ above the maximum value corresponding to the engine speed N6.

In summary, it will be seen that the present invention provides, in a novel and economical manner, an improved fuel injection timing control device which overcomes the drawbacks of the prior art and substantially reduces the emission of pollutants into the stmosphere, the means for advancing the injection timing during starting representing a highly useful improvement to the operation of the internal combustion engines.

What is claimed is:

1. A fuel injection timing control device comprising:

a timing control member movable between a minimum timing advance position and a maximum timing advance position;

a first piston connected to said timing control member such that the position of said timing control member corresponds to the position of the first piston;

a first biasing means urging said first piston and thereby said timing control member toward the minimum advance position;

a pressure passageway communicating with said first piston such that fluid under pressure in said pressure passageway urges said first piston and thereby said timing control member toward the maximum advance position;

a second piston engageable with said first piston;

a second biasing means urging said second piston to engage with said first piston so as to urge said first piston and thereby said timing control member toward the maximum advance position, said pressure passageway communicating with said second piston such that fluid under pressure in said pressure passageway urges said second piston to disengage from said first piston;

said first biasing means imposing a first preload biasing force on said first piston and said second biasing means imposing a second preload biasing force on said second piston such that fluid under pressure in said pressure passageway just sufficient to overcome the first preload biasing force is greater than fluid under pressure in said pressure passageway just sufficient to overcome the second preload biasing force.

2. A timing control device as in claim 1, in which the first and second biasing means are first and second springs.

3. A timing control device as in claim 1, further comprising a power amplifier connecting the piston with the control member.

4. A timing control device as in claim 2, further comprising:

a housing formed with a bore;

a partition dividing the bore into first and second chambers, the partition being formed with a central opening therethrough;

a power piston sealingly slidable in the first chamber and being formed with a bore which is closed at an end thereof facing the partition, said first piston being sealingly slidable in the bore of said power piston, said first spring urging said first piston toward the partition;

the pressure passageway extending through the housing and power piston and opening into the bore of said power piston between said first piston and the closed end of the bore of said power piston, a non-pressurized passageway communicating with the bore of said power piston external of said first piston, said power piston being further formed with a power passageway leading from the bore of said power piston and communicating with the first chamber between said power piston and the partition, said first piston being arranged to automatically connect the power passageway to one of the pressure passageway and the non-pressurized passageway to maintain an opening of the power passageway into the bore of said power piston in alignment with said first piston;

said second piston being sealingly slidable in the second chamber and extending through the central opening of the partition for engagement with said power piston.

5. A timing control device as in claim 1, in which a third predetermined fluid pressure in the pressure passageway which is just sufficient to urge the second piston to disengage from the first piston is between the second and first predetermined fluid pressures in the pressure passageway respectively.

* * * * *